US010087591B1

(12) United States Patent
Moore et al.

(10) Patent No.: US 10,087,591 B1
(45) Date of Patent: Oct. 2, 2018

(54) EXPANSION JOINT SYSTEM

(71) Applicant: Watson Bowman Acme Corporation, Amherst, NY (US)

(72) Inventors: Gary Moore, Orchard Park, NY (US); Thomas Buchanan, Blasdell, NY (US); Adam Smith, Buffalo, NY (US); Paul Pumm, Tonawanda, NY (US)

(73) Assignee: Watson Bowman Acme Corporation, Amherst, NY (US)

( * ) Notice: Subject to any disclaimer, the term of this patent is extended or adjusted under 35 U.S.C. 154(b) by 0 days.

(21) Appl. No.: 15/876,729

(22) Filed: Jan. 22, 2018

Related U.S. Application Data

(60) Provisional application No. 62/573,426, filed on Oct. 17, 2017.

(51) Int. Cl.
*E01D 19/06* (2006.01)
*E01C 11/02* (2006.01)

(52) U.S. Cl.
CPC ..... *E01D 19/065* (2013.01); *E01C 11/02* (2013.01)

(58) Field of Classification Search
CPC ..... E01D 19/065; E01C 11/02; E01C 11/04; E01C 11/06
USPC .. 52/393, 394, 395, 396.02, 396.04, 396.05, 52/396.07, 396.08, 573.1; 404/47, 50, 51, 404/68; 14/73.1, 73.5
See application file for complete search history.

(56) References Cited

U.S. PATENT DOCUMENTS 6,499,265 B2 * 12/2002 Shreiner ..... E01D 19/06 404/68
7,389,555 B2 * 6/2008 Xu ..... E01D 19/06 14/73.1
7,484,259 B2 * 2/2009 Xu ..... E01D 19/06 14/73.1

(Continued)

OTHER PUBLICATIONS

Mageba Product Brochure, "Mageba Expansion Joint—for lasting driving comfort," Tensa Flex Type RC, dated Feb. 2014.

(Continued)

*Primary Examiner* — Brian E Glessner
*Assistant Examiner* — Adam G Barlow
(74) *Attorney, Agent, or Firm* — Curatolo Sidoti Co., LPA; Joseph G. Curatolo; Salvatore A. Sidoti

(57) ABSTRACT

An expansion joint system for bridging a gap between spaced apart structural members and for accommodating transverse movement. The expansion joint system includes a plurality of finger plates carrying a plurality of elongated fingers that are configured to at least partially extend across an expansion joint gap from opposing structural members. The finger plates are pivotably mounted to the underlying structural members to permit pivoting or rotating movement in the transverse direction. A torsion spring is engaged with the pivotable finger plates and provides a restoring force to the finger plate when the finger plate rotates relative to the spring. Also disclosed is an expansion joint including spaced-apart structural members and the expansion joint system installed in the joint. The elongated fingers of the finger plates of the expansion joint system extend at least partially across the expansion joint gap from a first structural member and are interdigitated with elongated fingers extending from a opposing second structural member to provide a surface to traverse the expansion joint gap.

28 Claims, 5 Drawing Sheets

(56) References Cited

U.S. PATENT DOCUMENTS

| | | | | |
|---|---|---|---|---|
| 8,267,617 | B2 * | 9/2012 | Bradford | E01D 19/065 404/47 |
| 2005/0241084 | A1 * | 11/2005 | Delis | E01D 19/065 14/73.5 |
| 2007/0199267 | A1 * | 8/2007 | Moor | E01D 19/06 52/393 |
| 2009/0064602 | A1 * | 3/2009 | Lee | E01D 19/06 52/167.1 |
| 2017/0037644 | A1 * | 2/2017 | Gazzotti | B29C 39/10 |

OTHER PUBLICATIONS

Mageba Product Brochure, "Mageba Expansion Joint—for lasting driving comfort," Tensa Finger Type GF, dated Mar. 2013.
Freyssinet Product Brochure, "Freyssinet Expansion Joints. Design, Build, Maintain," pp. 20-25 (CIPEC WP Joint and NFT Joint), dated Sep. 2015.
WABO Finger Expansion Joint Drawing No. B-31718, dated Jun. 17, 2016.
Mageba Tensa Finger Type RSFD Drawing, dated Dec. 4, 2009.
Mageba Tensa Finger Type GF 240 Drawing, dated May 17, 2004.
Mageba Tensa Finger Type GF 360 Drawing, dated Feb. 2, 2004.
Mageba Tensa Finger Type GF 480 Drawing, dated Feb. 2, 2004.
Mageba Tensa Finger Type GF 600 Drawing, dated Feb. 2, 2004.
Mageba Tensa Finger Type GF 800 Drawing, dated Feb. 2, 2004.
Mageba Tensa Finger Type GF 1000 Drawing, dated Feb. 2, 2004.
Mageba Tensa Finger Type RC 100 Drawing, dated May 30, 2005.
Mageba Tensa Finger Type RC 200 Drawing, dated May 30, 2005.
Mageba Tensa Finger Type RC 300 Drawing, dated May 1, 2005.
Mageba Tensa Finger Type RC 400 Drawing, dated May 30, 2005.
Mageba Tensa Finger Type RC 500 Drawing, dated Sep. 14, 2005.
Mageba Tensa Finger Type RC 600 Drawing, dated Apr. 4, 2006.
Mageba Tensa Finger Type RC 700 Drawing, dated Apr. 4, 2006.

* cited by examiner

EXPANSION JOINT SYSTEM

CROSS REFERENCE TO RELATED APPLICATIONS

The present application claims the benefit of the filing date, under 35 U.S.C. § 119(e), from U.S. Provisional Application For Patent Ser. No. 62/573,426, filed Oct. 17, 2017, which is hereby incorporated in its entirety by reference.

TECHNICAL FIELD

The present disclosure is directed to an expansion joint system for bridging a gap between spaced apart structural members. Additionally disclosed is an expansion joint having the expansion joint system mounted to underlying spaced-apart structural members. Constructions, such as roadway and bridge structures, incorporating the expansion joint system are further provided.

BACKGROUND

Dimensional changes occur between structural members in response to expansion and contraction due to, for example, temperature changes, shortening and creep caused by pre-stressing concrete members, seismic cycling, vibrations, deflections caused by live loads, and longitudinal forces caused by wind loads, and vehicular traffic. A gap is purposefully provided between the adjacent structural members for accommodating the dimension changes. These dimensional changes result in the expansion and contraction of the width of the gap between the spaced apart structural members. Expansion joint systems are positioned within the gap to accommodate the movements in the vicinity of the gap, but still permit flow of traffic across the gap.

Finger joint expansion joint systems are one type of expansion joint system that is utilized in bridge and roadway expansion joint applications. Finger joint expansion joint systems utilize plates in the form of elongated fingers which bridge the gap between spaced apart structural members. The fingers of the plates connected to one structural member are interdigitated with the fingers of the finger plate connected to the opposing structural member to provide a consistent surface to allow traffic to traverse the gap.

Finger joints provide for longitudinal movement across the expansion joint gap in the relative directive of traffic. While finger joint systems are preferred in certain jurisdictions, conventional finger joint systems are not capable of accommodating transverse movement (ie, movement in a direction that is perpendicular or substantially perpendicular to the longitudinal direction of traffic across the expansion joint gap) within the expansion joint gap.

Transverse movement must be accommodated in many expansion joint system designs, such as those which experience seismic cycling or seismic events. What is needed in the expansion joint industry is an improved finger joint expansion joint system that is capable of accommodating both longitudinal and transverse movement occurring within the vicinity of the expansion joint gap.

SUMMARY

Disclosed is an expansion joint system comprising a first support, a first plate comprising a plurality of fingers pivotally engaged with said first support, a first spring engaged with said first plate, a second underlying support, a second plate comprising a plurality of fingers pivotally engaged with said second underlying support, a second spring engaged with said second finger plate, wherein said first plurality of fingers and said second plurality of fingers are interdigitated, wherein said first plate and said second plate can pivot in the transverse direction, and wherein said first spring provides a restoring force to said first plate and said second spring provides a restoring force to said second plate when said first and second plates pivot in the transverse direction.

Additionally disclosed is an expansion joint comprising a first structural member, a second structural member spaced-apart in the longitudinal direction from said first structural member, a first support mounted to said first structural member, a first plate comprising a plurality of fingers pivotally engaged with said first support, a first spring engaged with said first plate, a second support, a second plate comprising a plurality of fingers pivotally engaged with said second support, a second spring engaged with said second finger plate, wherein said first plurality of fingers and said second plurality of fingers are interdigitated, wherein said first plate and said second plate can pivot in the transverse direction, and wherein said first spring provide a restoring force to said first plate and said second spring provides a restoring force to said second plate when said first and second plates pivot in the transverse direction.

Further disclosed is a bridge expansion joint comprising a first bridge structural member, a second bridge structural member spaced-apart in the longitudinal direction from said first bridge structural member, a first support mounted to said first bridge structural member, a first plate comprising a plurality of fingers pivotally engaged with said first support, a first spring engaged with said first plate, a second support mounted to said second bridge structural member, a second plate comprising a plurality of fingers pivotally engaged with said second support, a second spring engaged with said second plate, wherein said first plurality of fingers and said second plurality of fingers are interdigitated, wherein said first plate and said second plate can pivot in the transverse direction, and wherein said first spring provides a restoring force to said first plate and said second spring provides a restoring force to said second plate when said first and second plates pivot in the transverse direction.

Further disclosed is a roadway expansion joint comprising a first roadway structural member, a second roadway structural member spaced-apart in the longitudinal direction from said first roadway structural member, a first support mounted to said first roadway structural member, a first plate comprising a plurality of fingers pivotally engaged with said first support, a first spring engaged with said first plate, a second support mounted to said second roadway structural member, a second plate comprising a plurality of fingers pivotally engaged with said second support, a second spring engaged with said second plate, wherein said first plurality of fingers and said second plurality of fingers are interdigitated, wherein said first plate and said second plate can pivot in the transverse direction, and wherein said first spring provides a restoring force to said first plate and said second spring provides a restoring force to said second plate when said first and second plates pivot in the transverse direction.

BRIEF DESCRIPTION OF THE DRAWINGS

Certain illustrative embodiments of the expansion joint system, expansion joint, and bridge and roadway constructions are disclosed with reference to the accompanying drawings and are for illustrative purposes only. The disclosed subject matter is not limited in its application to the details of construction or the arrangement of the components illustrated in the drawings. Like reference numerals are used to indicate like components, unless otherwise indicated.

DETAILED DESCRIPTION

Figure 1:
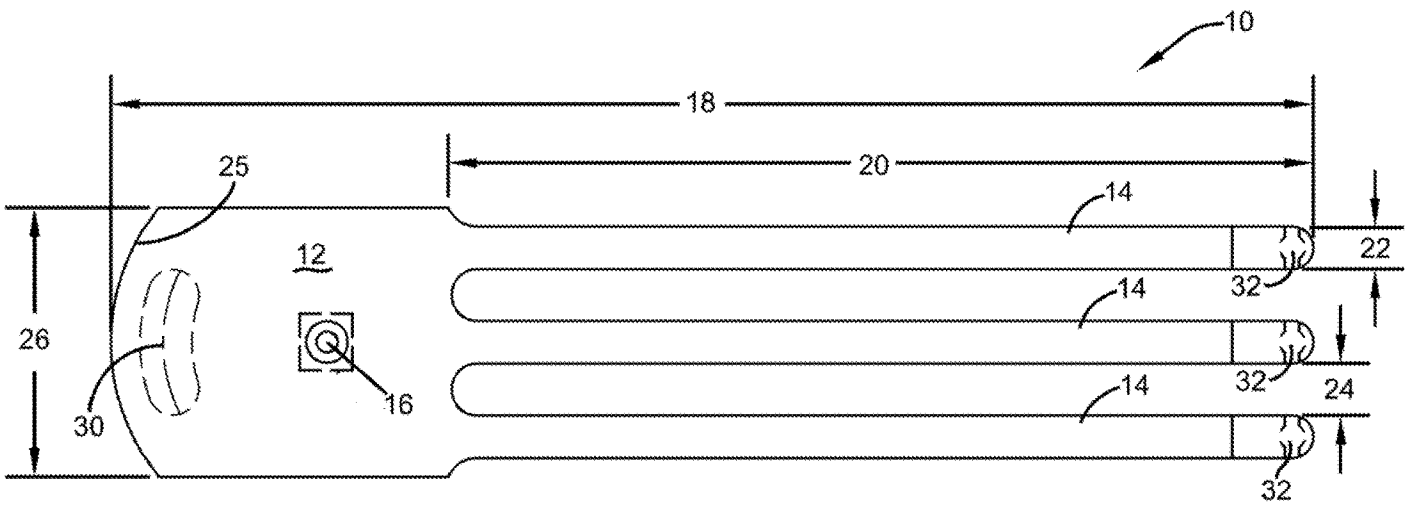
FIG. 1 is a plan view of an illustrative embodiment of the finger plate according to the present disclosure.

Disclosed is a finger-type expansion joint system for bridges and roads. The finger-type expansion joint system is able to system accommodate movements in all 6 degrees of freedom (forward/backward, up/down, and left/right). The finger-type expansion joint system comprises first and second supports, which may also referred to as support members. The first and second supports are positioned in a spaced-apart relationship in the longitudinal direction of the intended traffic across the expansion joint system. The first and second supports extend along the transverse axis of the expansion joint. According to certain illustrative embodiments, the first and second supports extend along the transverse axis of the entire length of the expansion joint. According to certain embodiments, each of the first and second supports may comprise a C-shaped channel member. According to other illustrative embodiments, each of the first and second supports may comprise a pair of opposite facing C-shaped channel members.

A first plate comprising a first plurality of elongated fingers is pivotally engaged with the first support. This first plate may also be referred to as the first finger plate. A first spring member is engaged with the first plate. According to certain embodiments, the first spring is engaged with the first finger plate and the first support member. According to other illustrative embodiments, the first spring is engaged with the first finger plate and is engaged with the underlying first support by locating the spring member between a pair of spaced-apart structural steel members.

A second plate comprising a second plurality of elongated fingers is pivotally engaged with the second support. This second plate may also be referred to as the second finger plate. A second spring member is engaged with the second plate. According to certain embodiments, the second spring is engaged with the second finger plate and the second support member. According to other illustrative embodiments, the second spring is engaged with the second finger plate and is engaged with the underlying second support by locating the spring member between a pair of spaced-apart structural steel members.

It should be noted that when the first and/or second finger plates are at rest, there is a pre-compression in the spring assembly, which creates an inherent hold-down force of the finger plates. Furthermore, when there is a vertical misalignment between the two supporting sides of the expansion joint, the distal ends of the finger plates will move upward, and the torsional spring will compress whereby allowing the base portion of the finger plate to move upward while rotating about support bearings.

The first finger plate includes a base portion and a plurality of elongated fingers that extend from the base portion of the first finger plate. The plurality of elongated fingers extend along a longitudinal axis of the first finger plate from the base portion of the first finger plate to the distal ends of fingers opposite the base portion of the first finger plate. The second finger plate includes a base portion and a plurality of elongated fingers that extend from the base portion of the second finger plate. The plurality of elongated fingers extend along a longitudinal axis of the second finger plate from the base portion of the second finger plate to the distal ends of fingers opposite the base portion of the second finger plate.

The first plurality of fingers of the first finger plate and the second plurality of fingers of the second finger plate of the expansion joint system are configured to extend longitudinally and in a substantially horizontal manner across an expansion joint gap located between two spaced-apart structural members. The plurality of fingers of the first finger plate and the plurality of fingers of the second finger plate are nested or interdigitated to provide a substantially horizontal traffic-bearing surface across the expansion joint gap between the two spaced-apart structural members.

The first finger plate and second finger plate of the expansion joint system are rotatably mounted to the underlying support members. The first and second finger plates are capable of pivoting or rotating in a horizontal plane. The first and second finger plates are also configured to pivot or otherwise rotate in the transverse direction relative to the direction of intended traffic across the expansion joint system.

According to certain illustrative embodiments, at least a portion of the plurality of fingers of said first and/or second finger plates further include a finger bearing engaged with an ends of the elongated fingers opposite of said base portion of said first and/or second finger plates. Without limitation, the finger bearing comprises a substantially cylindrical portion and axially aligned guide portions extending outwardly from the exterior surfaces of the cylindrical portion. The finger bearing may comprise a polymer or composite material. According to certain embodiments, the finger bearings comprise a polyurethane.

According to certain illustrative embodiments, the base portion of each of the first and second finger plates comprises opposite facing top and bottom surfaces. Each of the first and second finger plates include a first cavity or recess that is formed in thickness of the base portion of the finger plate from the bottom surface. The first cavity or recess is configured to accept and hold a finger plate bearing for supporting the base portion of each of the finger plates. A finger plate bearing member is engaged with the first recess of at least one of the first and second finger plates by inserting it at least partially into the first cavity or recess.

Without limitation, the finger plate bearing comprises a polymeric or composite material. According to certain embodiments, the finger plate bearing comprises a polyurethane bearing.

A first spring is engaged with the first finger plate. A second spring is engaged with the second finger plate. The first spring provides a restoring force to the first finger plate and the second spring provides a restoring force to the second plate when the first and second plates rotate in the transverse direction. When the expansion joint system is in the neutral position, the elongated fingers of the first and second finger plates extend in a longitudinal manner across the expansion joint gap. In response to transverse movement within the expansion joint, the first and second finger plates pivot or rotate in a traverse direction to accommodate the transverse movement. The first and second springs exert a torsional force on the first and second finger plates to return the finger plates to the neutral position with the elongated fingers extending across the expansion joint gap in a longitudinal direction. According to other illustrative embodiments, the restoring force could also be provided by a compressive spring force exerted by the first and second springs. According to yet further illustrative embodiments, the restoring force could be provided by a combination of torsional and compressive spring forces exerted by the first and second springs. Without limitation, and only by way of illustration, the expansion joint system may be used in bridge and roadway constructions to accommodate transverse movement occurring in the vicinity of the expansion joint.

According to certain illustrative embodiments, the spring assembly comprises a rigid top portion, a central torsion spring portion, and optionally a rigid bottom portion. According to other illustrative embodiments, the spring assembly comprises a rigid top portion, a central torsion spring portion, and a rigid bottom portion. The rigid top and bottom portions may be made of any material which is able to provide a rigid engagement between the finger plates and the spring assembly. By way of illustration, and not in limitation, suitable materials include metals, metal alloys, polymers, or composite materials.

The first and second finger plates also include a second cavity or recess formed in the bottom surface of the base portion of at least one of the first and second finger plates. According to certain illustrative embodiments, the second cavity or recess is non-circular in shape. According to further illustrative embodiments, the non-circular second recess is square shaped. The rigid top portion of the spring assembly comprises a non-circular portion which is configured to engage the non-circular recess of the first and second finger plates. The first and second spring assemblies of the expansion joint system are engaged with the first and second finger plates by engaging the rigid top portion of each spring assembly with the second recess of the first and second finger plates. This is accomplished by inserting the rigid top portion of the spring assembly at least partially into the second recess of the first and second finger plates. An elongated mechanical fastener is used to engage the first and second finger plates to the underlying first and second spring assemblies.

According to these embodiments, the rigid top portion of the spring assemblies engages the finger plates and the torsion spring portion to transfer force from the finger plates to the torsion spring members. The central torsion spring member comprises a material which is capable of accepting a torsional force in response to transverse movement within the expansion joint and providing a torsional restorative force to the first and second finger plates to restore them to the neutral position following transverse movement of the finger plates. In certain embodiments, the material of the torsion spring members comprises a polyurethane.

The engagement of the rigid portion of the spring assembly having a non-circular geometry or shape with a similarly shaped non-circular cavity or recess on the bottom surface of the finger plates allows the finger plates to engage the spring assembly such that rotational force experienced by the finger plates is transferred to the springs of the spring assembly. The spring of the spring assembly are capable of providing a torsional restorative force to the finger plates such that the finger plate will be able to rotate to accommodate transverse movement when installed in an expansion joint system and return to its neutral position when possible following the transverse movement. By providing a restorative force, the spring assembly supports and stabilizes the finger plates during movement experienced by the finger plate when installed in an expansion joint system.

As used in the present Specification, the term "longitudinal direction" means the direction of traffic across the expansion joint system.

As used in the present Specification, the term "transverse direction" means a direction that is perpendicular to the direction of traffic across the expansion joint system, or perpendicular to the longitudinal direction.

Additionally disclosed is an expansion joint including the expansion joint system. The expansion joint comprises a first structural member and a second structural member. The first and second structural members are positioned in a spaced-apart relationship in the longitudinal direction from first structural member to the second structural member. As the first and second structural are longitudinally separated an expansion joint gap exists between the vertical marginal edges of the first and second structural members. The underlying structural members may comprises concrete bridge or roadway structural members.

A first support is mounted to the first structural member. This support extends continuously in the transverse direction along the expansion joint. A plurality first finger plates are positioned in a side-by-side arrangement along the transverse axis of the expansion joint. Each of the first finger plates comprise a base portion and a plurality of elongated fingers that extend substantially horizontally in the longitudinal direction across the expansion joint gap. Each of the first finger plates are rotatably engaged with the underlying first support.

A second support is mounted to the second structural member. This support extends continuously in the transverse direction along the expansion joint. A plurality second finger plates are positioned in a side-by-side arrangement along the transverse axis of the expansion joint. Each of the second finger plates comprise a base portion and a plurality of elongated fingers that extend substantially horizontally in the longitudinal direction across the expansion joint gap. Each of the second finger plates are rotatably engaged with the underlying second support.

The first and second supports may be engaged with the underlying first and second structural members by at least partially embedding the first and second supports in the structural members, and/or by mechanical fasteners engaging both the supports and penetrating into the structural members. The first and second springs are independently engaged with the first and second supports. The first and second supports may comprise elongated C-shaped channels. Alternatively, the first and second support may comprise a pair of opposite facing elongated C-shaped channels.

The first plurality of elongated fingers carried by the first finger plates and the second plurality of fingers carried by the second finger plates extends substantially horizontally across the expansion joint gap and are interdigitated.

A first spring is engaged with each of the first finger plates that are rotatably mounted on the first support. A second spring is engaged with each of the second finger plates that are rotatably mounted on the second support. Each of the first plates mounted on the first support and each of the second plates mounted on the second support can pivot or rotate in the transverse direction to accommodate transverse movement within or around the expansion joint. The first spring provides a restoring force to the first plates and the second spring provides a restoring force to the second plates when the first and second plates experience pivoting or rotation in the transverse direction. Elongated fasteners are passed through the first and second finger plates and into said first and second spring assemblies to engage the finger plates to the underlying spring assemblies. According to certain embodiments, openings on the first and second finger plates are aligned with openings in the rigid top portion, torsional spring, and rigid bottom portion of the spring assembly. The elongated mechanical fasteners pass through the opening in the first and second finger plates and extend into the rigid top portion and spring of the spring assembly. According to other embodiments, the elongated mechanical fasteners pass through the opening in the first and second finger plates and extend into the rigid top portion, central torsional spring and rigid bottom portion of the spring assembly.

The spring assemblies include rotation prevention members that are engaged with the first and second springs to prevent the springs from rotating in the transverse direction with the first and second finger plates. The rotation prevention member may include a substantially planar plate member having a non-circular opening to accept a non-circular geometry of the top rigid portion of the spring assembly to prevent rotation of the springs during transverse movement. The planar plate member is mounted to first and second supports by one or more mechanical fasteners. The rigid top portion of the spring assembly extends through the opening of the planar plate member and into the aligned second cavity or recess formed in the bottom surface of the base portion of the first and second finger plates to engage the spring assembly to the first and second finger plates.

In certain embodiments, plate member is positioned between the bottom surfaces of the finger plates and the spring assembly. The plate is anchored to the underlying structural members through the first and second supports and a plurality of fasteners. The fasteners pass through the finger plate, through the additional plate member and into the spring assembly. The plate member is independently fastened to the first and second structural members. In certain embodiments, the fastener comprises an elongated bolt having a head and a threaded portion depending downwardly from the head of the bolt. The head of the bolt head engages the hole in the finger plates, and the threaded portion threads downwardly into at least a portion of the spring assembly.

Figure 2:
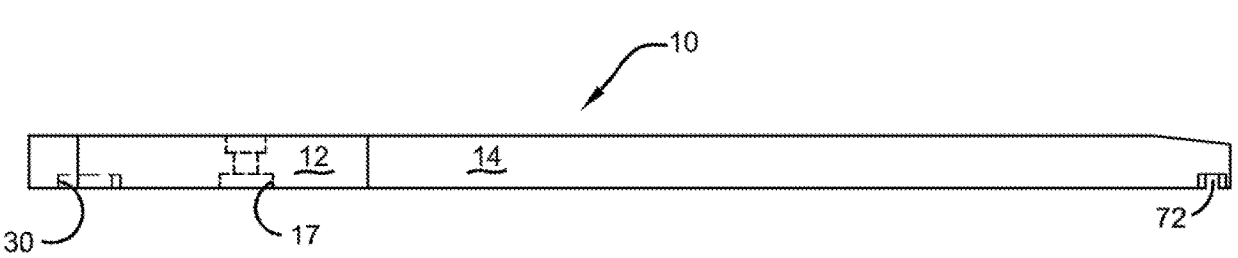
FIG. 2 is an elevation view of the illustrative embodiment of the finger plate of FIG. 1.
Figure 6:
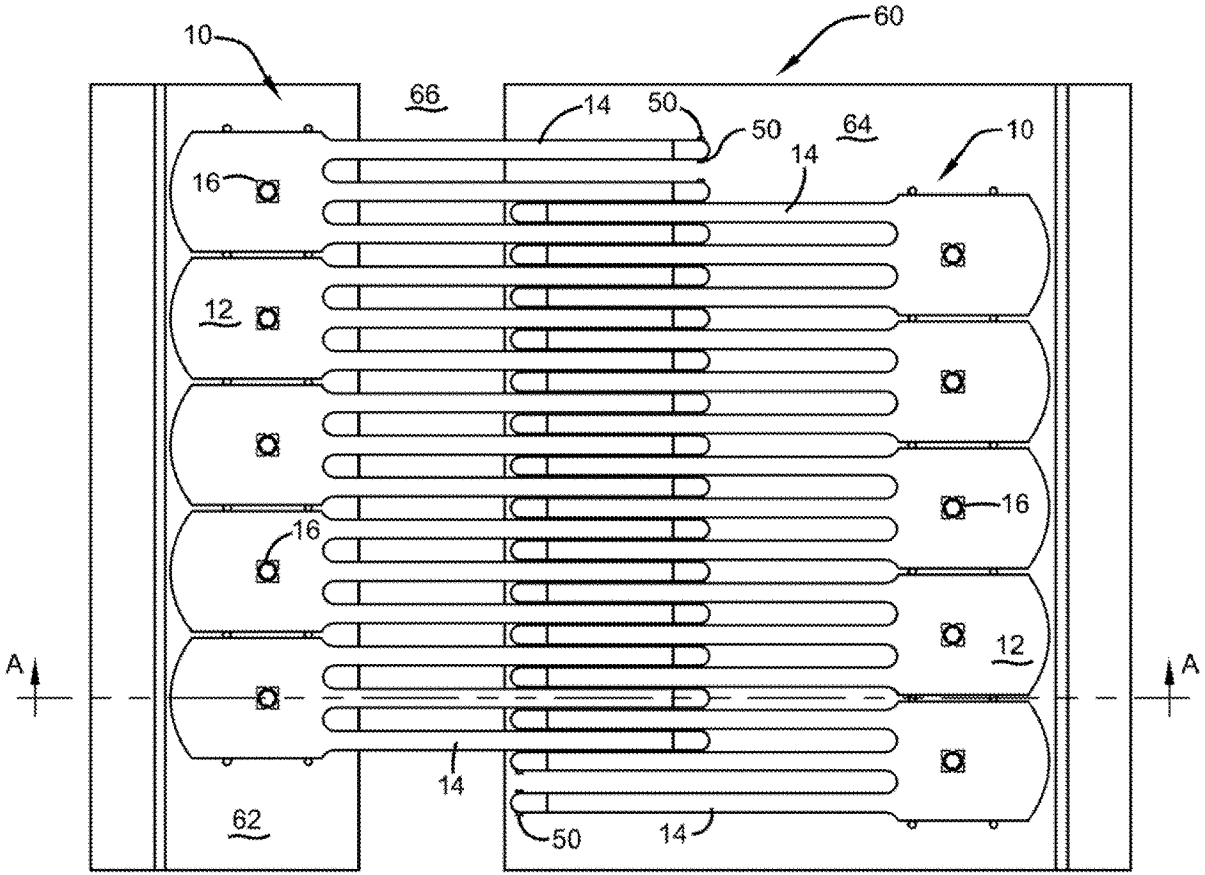
FIG. 6 is a plan view of an illustrative embodiment of the expansion joint system according to the present disclosure.

FIGS. 1 and 2 show an illustrative of embodiment of the finger plate 10 of the expansion joint system. Finger plate 10 includes a base portion 12 and a plurality of elongated fingers 14 extending from the base 12. According to the embodiment depicted in FIG. 1, the finger plate 10 includes three elongated fingers 14 extending from base 12. The finger plate 10 is depicted in FIG. 1 as having three elongated fingers 14, but it is contemplated that the finger plate 10 may have any number of fingers 14 as may be desired based upon the particular application of the finger plate 10. The finger plate 10 also has a total length 18, and each finger portion 14 has a finger length 20 and a finger width 22. A finger gap 24 between adjacent fingers 14 allows for interdigitating with elongated finger portions (not shown) of opposing finger plates (not shown) when installed across an expansion joint gap (as depicted in FIG. 6, for example). The finger plate has a total width 26 and a radius 28. The radius 28 allows the finger plate 10 to rotate when an expansion joint in which the finger plate 10 is installed experiences transverse movement.

Base 12 further includes a hole 16 extending downwardly through the thickness of finger plate 10 from a first major surface of finger plate 10 toward a second major surface of finger plate 10. Hole 16 is in open communication with recess 17 formed in the second major surface of the base portion 12 of the finger plate 10. According to the illustrative embodiment depicted in FIG. 1, the recess 17 is a non-circular recess 17. According to further embodiments, hole 16 is a substantially circular hole that is in open communication with a square shaped recess 17 formed in the underside of the base portion 12 of finger plate 10. It is also contemplated that the recess 17 may be any non-circular shape, and that the through-hole 16 may not be required if the recess 17 adequately engages the finger plate 10 with a spring assembly (as shown in FIG. 3, for example).

The finger plate 10 may comprise a plate bearing engagement recess 30 which allows the finger plate 10 to rest on a bearing member 72 to provide support and stability to the finger plate 10 when installed in an expansion joint. Each finger 14 may further individually comprise a finger bearing engagement recess 32 which allows the finger portion 14 to rest on a finger bearing 50 of the expansion joint system to provide support and stability to the finger portion 14 when installed in an expansion joint. The finger plate bearing engagement recess 30 and finger bearing engagement recess 32 comprise separate recesses formed in the underside of the base portion 12 or fingers 14 of the finger plates 10, respectively.

Figure 3:
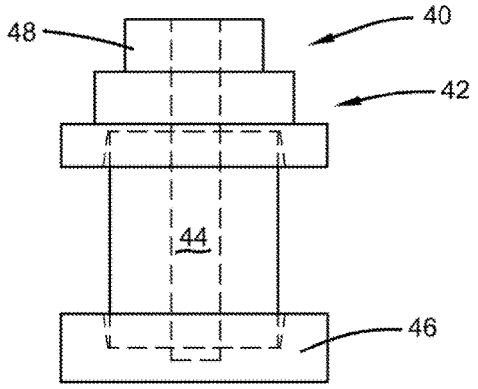
FIG. 3 is a schematic diagram of an illustrative embodiment of the spring assembly according to the present disclosure.
Figure 4:
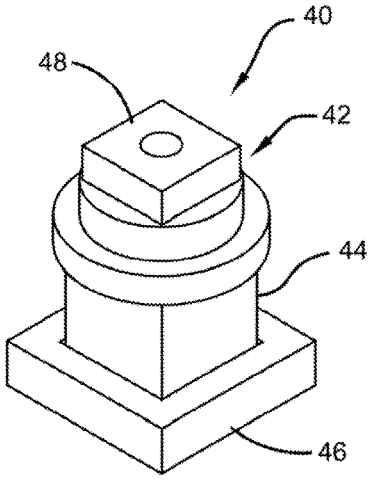
FIG. 4 is an isometric view of an illustrative embodiment of the spring assembly of FIG. 3.

FIGS. 3 and 4 show an illustrative embodiment of the spring assembly 40 of the expansion joint system for engaging the finger plates to underlying support members. As shown in FIGS. 3 and 4, spring assembly 40 includes a rigid top portion 42, a central torsion spring portion 44 and an optional rigid bottom portion 46. The rigid top portion 42 may comprise a non-circular geometry 48 that is configured to engage the non-circular recess 17 formed in the underside of the base portion 12 of the finger plate 10 depicted in FIG. 1. In FIGS. 3 and 4, the non-circular portion 48 is depicted as being square in shape, but it is contemplated that any non-circular shape may suitably engage the spring assembly 40 with a finger plate 10.

Figure 5:
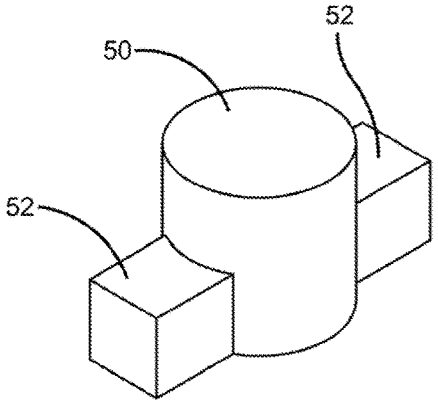
FIG. 5 is an isometric view of an illustrative embodiment of the bearing according to the present disclosure.

FIG. 5 shows an illustrative embodiment of the finger bearing 50 of the expansion joint system. The finger bearing 50 is adapted to engage a finger bearing engagement recess 32 of a finger portion 14 of the finger plate 10 depicted in FIGS. 1 and 2. For example, and without limitation, the geometry of a portion of the finger bearing 50 is configured to be inserted within the finger bearing engagement recess 32 of the fingers 14. The finger bearing 50 may comprise at least one protrusion 52 to guide finger portion 14 and maintain adjacent finger portions 14 separated, when installed in an expansion joint (as depicted in FIG. 6) and during normal use.

Figure 7:
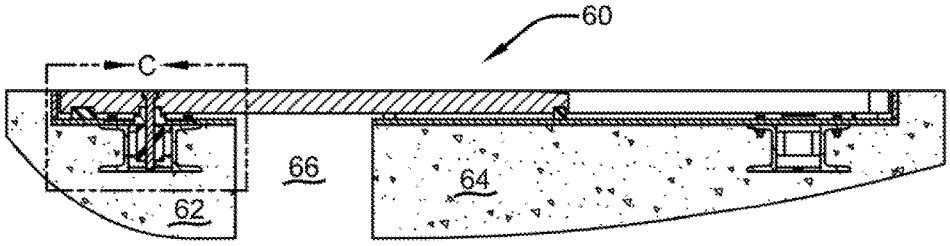
FIG. 7 is an elevation view of the illustrative embodiment of the expansion joint system of FIG. 6.
Figure 8:
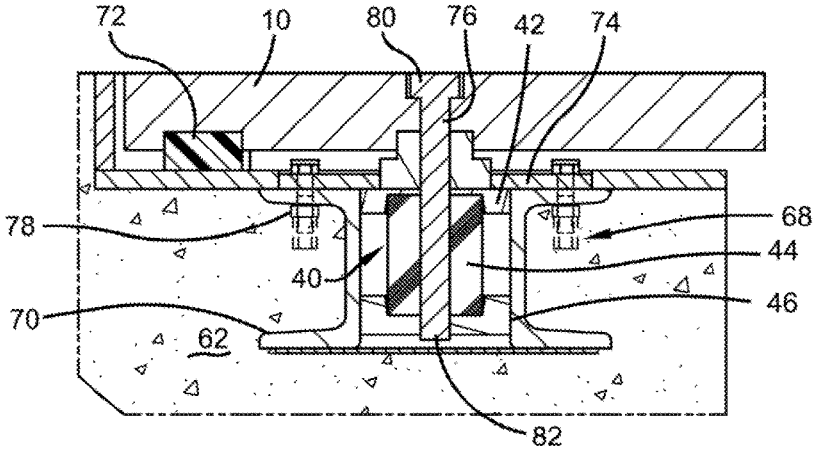
FIG. 8 is an enlarged fragmentary view showing an illustrative embodiment of the spring assembly of the expansion joint system of FIG. 7.
Figure 9:
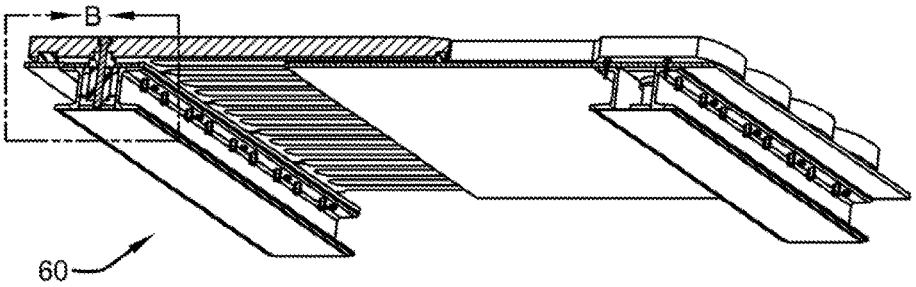
FIG. 9 is an isometric view of the underside of the illustrative embodiment of the expansion joint system of FIG. 7.
Figure 10:
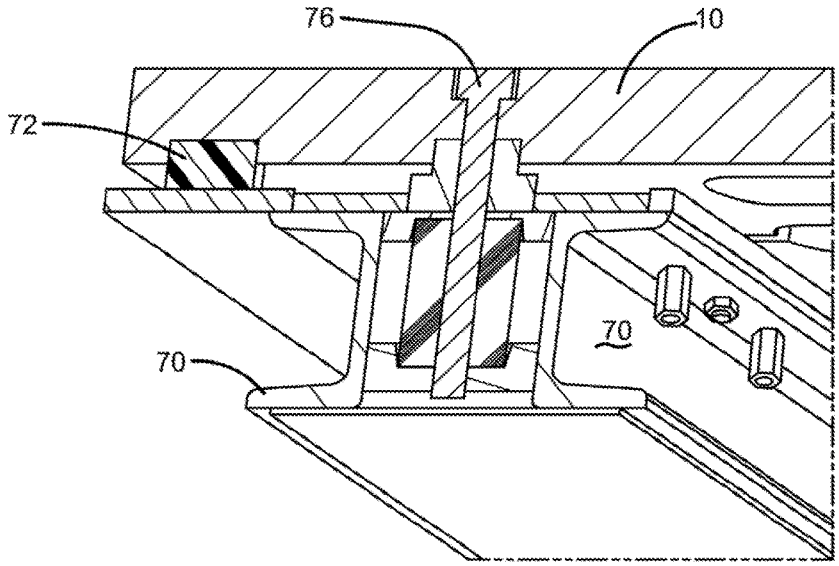
FIG. 10 is an enlarged fragmentary view showing an illustrative embodiment of the spring assembly of the expansion joint system of FIG. 9.
Figure 11:
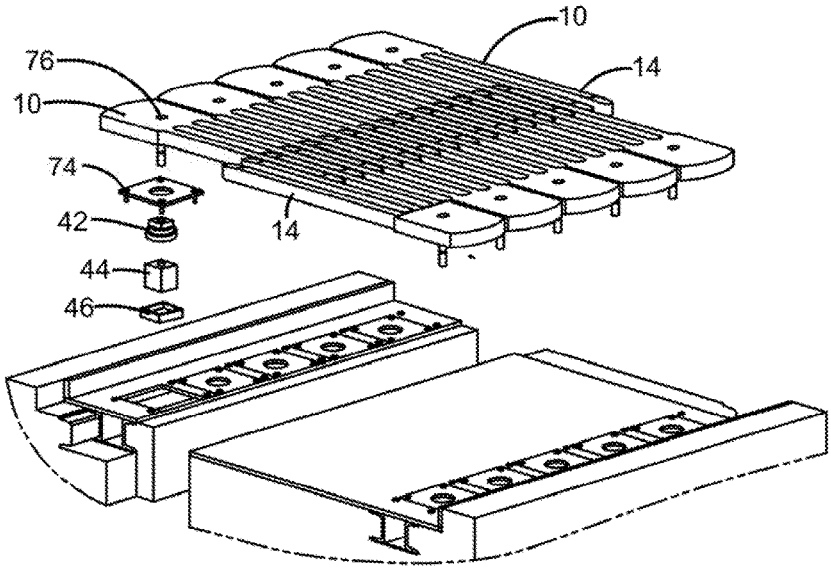
FIG. 11 is an exploded isometric view of the illustrative embodiment of the expansion joint shown in FIG. 6.

FIG. 6 shows an illustrative embodiment of expansion joint system 60. FIG. 7 shows a cross-section of the expansion joint system 60 through line A-A of FIG. 6. FIG. 8 is a fragmentary view of FIG. 7 and shows a portion of FIG. 7 at location C of FIG. 7 in greater detail. FIG. 9 shows an isometric view of the expansion joint system 60. FIG. 10 shows a detail of a portion of FIG. 9 at location B of FIG. 9. FIG. 11 shows an exploded view of the expansion joint system 60.

The expansion joint system 60 bridges a gap 66 between a first structural member 62 and a second structural member 64. The expansion joint system 60 comprises a plurality of finger plate assemblies as described herein. Each finger plate assembly comprises a finger plate 10 and a spring assembly 40 as described above and shown in FIGS. 1 to 4. Finger plate assemblies also include support members that engage, or that are otherwise mounted or secured to the underlying structural members 62, 64. Finger plates 10 are mounted on structural members 62, 64 on opposite sides of the expansion joint gap 66. The elongated finger portions 14 of the finger plates 10 extend across the gap 66 from opposing sides of the gap 66. The expansion joint system 60 comprises a plurality of anchors or mechanical fasteners 68 for securing at least one support member 70 to the underlying structural members, such as underlying bridge or roadway structural members. The finger portions 14 of opposing finger plates 10 are interdigitated to effectively bridge the gap 66 located between structural members 62, 64.

The expansion joint system 60 may further comprise at least one finger bearing 50 engaged with the ends of the elongated fingers 14 opposite the end of the base portion 12. The finger bearings 50 support the ends of the plurality of finger portions 14 of the finger plates 10. The finger bearing 50 may optionally comprise at least one protrusion 52 (as shown in FIG. 5) which guides the interdigitated finger portions 14 and maintains equidistance between adjacent elongated fingers 14.

The expansion joint system 60 may additionally comprise at least one bearing 72 engaged with each finger plate 10 used in any given installation of the expansion joint system 60. As shown in FIGS. 8 and 10, bearing 72 is engaged with the base portion 12 of the finger plate 10 through a recess formed in the underside of the base portion 12 of the plate 10. Bearing 72 supports the base portion 12 of a finger plate 10 when the expansion joint system is installed within an expansion joint. Bearing 72 is of such geometry to allow for uniform pressure between finger plate 10 and support plate 62 and 64 throughout the movement range of the finger joint system 60. Bearing 72 is radiused to accommodate rotation of the finger plates 10 and remain in full and uniform contact with the underlying supporting structure.

As shown in FIG. 8, the expansion joint system 60 may further comprise a plate member 74 that is positioned between the underside of the finger plate 10 and the upper surface of the underlying support member 70. The plate member 74 is mounted to the underlying support member 70 by fasteners 68, 78. In the illustrative embodiment shown in FIG. 8, the first supports are provided as C-shaped channels 70 that are at least partially embedded within the underlying concrete structural member 62. C-shaped channels are shown in figures, but any form of creating a void within member 62 such that bearing 40 can be inserted into a pocket formed within 62 and 68 can be fastened to 62 is considered reasonable equivalents to this embodiment. Fasteners 68, 78 pass through plate member 74 and C-shaped channels 70 to mount the plate member 74. An elongated fastener 76 passes through an opening located in the finger plate 10 and into the spring assembly 40 to engage the finger plate 10 with the spring assembly 40. The head 80 of the fastener 76 head engages the finger plate 10 with the top surface of the head 80 of the fastener 76 being substantially flush or level with the top surface of the finger plate 10. The elongated threaded portion 82 of the fastener 76 threads into at least a portion of the spring assembly 40. The threaded portion 82 passes through the top rigid portion 42 and the torsion spring portion 44, and threads into the rigid bottom portion 46 of the spring assembly 40. The underside of finger plate 10 includes a recess to engage a portion of the top rigid portion 42 of the spring assembly 40. The plate 74 and the fastener 76 together pivotally mount the finger plate 10 to the underlying structural member 62.

It will be understood that the embodiments described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

The invention claimed is:

1. An expansion joint system comprising:
- a first support;
- a first plate comprising a plurality of fingers pivotally engaged with said first support;
- a first spring engaged with said first plate;
- a second support;
- a second plate comprising a plurality of fingers pivotally engaged with said second support;
- a second spring engaged with said second plate;
- wherein said first plurality of fingers and said second plurality of fingers are interdigitated and are located in a plane;
- wherein said first plate and said second plate can pivot in a transverse direction in the plane; and
- wherein said first spring provides a restoring force to said first plate and said second spring provides a restoring force to said second plate to return said first and second finger plates to the neutral position in response to said first and second plates pivoting in the transverse direction.

2. The expansion joint system of claim 1, wherein said first and second supports comprise elongated C-shaped channels.

3. The expansion joint system of claim 2, wherein said first and second supports comprise a pair of opposite facing elongated C-shaped channels.

4. The expansion joint system of claim 1, wherein each of said first and second finger plates comprise a base portion and said plurality of fingers extend along a longitudinal axis from said base portion.

5. The expansion joint system of claim 4, wherein said plurality of fingers of at least one of said first and second finger plates comprise three elongated and spaced-apart fingers.

6. The expansion joint system of claim 5, wherein at least one of said plurality of fingers of said first and/or second finger plates further comprises at least one finger bearing engaged with an end of the at least one of said plurality of fingers opposite of said base portion of said first and/or second finger plates.

7. The expansion joint system of claim 6, wherein said bearing comprises a substantially cylindrical portion and axially aligned guide portions extending from said cylindrical portion.

8. The expansion joint system of claim 7, wherein said at least one finger bearing comprises a polyurethane.

9. The expansion joint of claim 5, wherein said base portion of said first and second finger plates comprises opposite facing top and bottom surfaces and further comprises a first recess formed in said bottom surface.

10. The expansion joint system of claim 9, further comprising at least one finger plate bearing engaged with said first recess of at least one of said first and second finger plates and supporting said base portion of said finger plates.

11. The expansion joint system of claim 10, wherein said at least one finger plate bearing comprises a polyurethane bearing.

12. The expansion joint system of claim 5, further comprising a second recess in said bottom surface of said base portion of said first and second finger plates and wherein said recess is non-circular.

13. The expansion joint system of claim 12, wherein said non-circular recess is square shaped.

14. The expansion joint system of claim 1, wherein said first and second springs are engaged with a rigid top portion and a rigid bottom portion.

15. The expansion joint system of claim 14, wherein said rigid top portion comprises a non-circular portion which engages said non-circular recess of said first and second finger plates.

16. The expansion joint of claim 1, wherein said first and second springs are torsional springs and provide a torsional restoring force to said first and second finger plates when said finger plates pivot in the transverse direction.

17. The expansion joint system of claim 1, further comprising fasteners comprising an elongated bolt having a head and a threaded portion, wherein said head of said fasteners engages said first and/or second finger plates, and wherein said threaded portion of said fasteners threads into said spring.

18. An expansion joint comprising:

a first structural member;

a second structural member spaced-apart in the longitudinal direction from said first structural member;

a first support mounted to said first structural member;

a first plate comprising a plurality of fingers pivotally engaged with said first support;

a first spring engaged with said first plate;

a second support;

a second plate comprising a plurality of fingers pivotally engaged with said second support;

a second spring engaged with said second plate;

wherein said first plurality of fingers and said second plurality of fingers are interdigitated and are located in a plane;

wherein said first plate and said second plate can pivot in a transverse direction in the plane; and wherein said first spring provides a restoring force to said first plate and said second spring provides a restoring force to said second plate when said first and second plates pivot in the transverse direction.

19. The expansion joint of claim 18, comprising a plurality of first and second finger plates positioned in a side-by-side arrangement along the transverse axis of said expansion joint.

20. The expansion joint of claim 19, wherein said plurality of fingers of said first and second finger plates extend across said gap from said first and second structural members, and wherein said plurality of fingers of said first finger plate extending from said first structural member are interdigitated with said plurality of fingers of said second finger plate extending from said second structural member.

21. The expansion joint of claim 20, wherein said first and second finger plates are pivotally mounted to said structural members with fasteners.

22. The expansion joint of claim 21, further comprising a rotation prevention member engaged with said first and second springs to prevent said springs from rotating with said first and second finger plates.

23. The expansion joint of claim 22, further comprising fasteners passing through said first and second finger plates and into said first and second springs.

24. The expansion joint of claim 18, wherein said first and second supports comprise elongated C-shaped channels.

25. The expansion joint of claim 24, wherein said first and second support comprise a pair of opposite facing elongated C-shaped channels.

26. The expansion joint of claim 25, wherein said first and second springs are independently engaged with said first and second supports.

27. The expansion joint of claim 26, wherein a support plate is mounted to said first and second supports by fasteners.

28. An expansion joint for a bridge or roadway comprising:

a first bridge or roadway structural member;

a second bridge or roadway structural member spaced-apart in the longitudinal direction from said first bridge or roadway structural member;

a first support mounted to said first bridge or roadway structural member;

a first plate comprising a plurality of fingers pivotally engaged with said first support;

a first spring engaged with said first plate;

a second support mounted to said second bridge or roadway structural member;

a second plate comprising a plurality of fingers pivotally engaged with said second support, a second spring engaged with said second plate;

wherein said first plurality of fingers and said second plurality of fingers are interdigitated and are located in a plane, wherein said first plate and said second plate can pivot in a transverse direction in the plane, and wherein said first spring provides a restoring force to said first plate and said second spring provides a restoring force to said second plate when said first and second plates pivot in the transverse direction.

* * * * *